US005299611A

United States Patent [19]

Cirone

[11] Patent Number: 5,299,611

[45] Date of Patent: Apr. 5, 1994

[54] PROTECTIVE PUTTER COVERS

[76] Inventor: Dominick Cirone, 1410 Brett Pl., Apt. #136, San Pedro, Calif. 90732

[21] Appl. No.: 826,977

[22] Filed: Jan. 28, 1992

[51] Int. Cl.[5] ..... A63B 57/00

[52] U.S. Cl. ..... 150/160; 206/315.4

[58] Field of Search ..... 150/159, 160; 206/315.4

[56] References Cited

U.S. PATENT DOCUMENTS

| | | | |
|---|---|---|---|
| D. 191,315 | 9/1961 | Damiani et al. | D21/221 |
| 2,115,307 | 4/1938 | Kneeter | 150/160 |
| 2,417,336 | 3/1947 | Whitehead | 150/160 |
| 3,072,167 | 1/1963 | Banas | 150/160 |
| 3,255,794 | 6/1966 | Morse | 150/160 |
| 3,426,815 | 2/1969 | Ashlin et al. | 150/160 |
| 3,478,799 | 11/1969 | Hoyt, Jr. | 150/160 |
| 3,593,769 | 7/1971 | Spears | 150/160 |
| 3,977,451 | 8/1976 | Duba | 150/159 X |
| 4,119,129 | 10/1978 | Freiberg | 150/160 |
| 4,971,126 | 11/1990 | Borenstein | 206/315.4 |
| 5,005,624 | 4/1991 | Sung | 150/160 |
| 5,105,863 | 4/1992 | Cirone | 150/160 |

FOREIGN PATENT DOCUMENTS

| | | | |
|---|---|---|---|
| 261329 | 5/1965 | Australia | 206/315.2 |
| 1360058 | 7/1974 | United Kingdom | 206/315.2 |
| 1397252 | 6/1975 | United Kingdom . | |
| 2133700 | 8/1984 | United Kingdom | 150/160 |
| 2233239 | 1/1991 | United Kingdom | 150/160 |

*Primary Examiner*—Sue A. Weaver

*Attorney, Agent, or Firm*—George T. Marcou; Marks & Murase

[57] ABSTRACT

A golf putter cover formed from an elastic material such as neoprene is disclosed. The putter cover may be formed from a single piece of material with an opening formed therein and may be constructed by folding the material and joining the opposing sides in a single joining operation. The putter cover is reversible, water resistant and is adapted for maximizing the visibility of printed matter thereon.

11 Claims, 3 Drawing Sheets

PROTECTIVE PUTTER COVERS

FIELD OF THE INVENTION

The present invention relates generally to covers for golf clubs and more specifically to covers for "putters."

CROSS REFERENCE TO RELATED APPLICATIONS

Applicant hereby references commonly owned, copending U.S. patent application Ser. No. 07/735,915, entitled "NEOPRENE IRON COVERS", filed on Jul. 25, 1991 now U.S. Pat. No. 5,105,863. The subject matter of this application is incorporated by reference as if fully set forth herein.

BACKGROUND OF THE INVENTION

It is well known to provide protective covers for the striking heads of golf clubs to prevent damage to or by the club head. Such damage may occur, for example, by the clubs scratching or banging together, through the constant removal and replacement of other clubs, or by oxidation due to exposure to water. While putter covers in general are known, there is a need for an improved putter cover due to the drawbacks and disadvantages of the known putter covers as discussed below.

For example, U.S. Pat. No. 4,119,129 issued to Freiberg discloses a putter cover constructed of a non-elastic material such as leather, vinyl or the like. The putter cover is constructed by joining two pieces of material along a top and side edges 14, 16 and 18)and partially joining the pieces along a bottom edge to form an opening 26. Since the material is non-elastic, a large opening must be formed to accommodate the putter as it is inserted, increasing the susceptibility of the putter to oxidation, e.g. due to the intrusion of water. Moreover, due to the nature of the putter cover construction, the visibility of any printed matter that may have been placed on the cover is reduced. Other embodiments are described (FIGS. 3–4) one of which discloses folding one side edge. However, these embodiments both describe open (unjoined edges) which are contrary to certain aspects of the present invention.

U.S. Pat. No. 3,072,167 issued to Banas describes a putter cover formed from a single piece of elastic material which requires multiple folds and multiple stitching steps. By folding and stitching the material, an undesirable double thickness of material is provided in certain regions, resulting in an unnecessary waste of material and space. Moreover, the manufacturing process requires additional steps (folding and stitching) adding time and cost thereto. Like Freiberg, the opening in the putter cover is formed by only partially stitching opposing sides along one edge thereby leaving a relatively large opening. Also like Freiberg, this construction reduces the visibility of any printed matter on the putter cover. Moreover, while the elastic nature of the material may allow the putter cover to be reversed (if desired), such reversal would result in an uneven appearance to the putter cover due to the double thickness regions normally hidden within the cover. Reversal would also interfere with the insertion of the putter due to the tabs or loops (29) normally on the exterior of the putter cover.

Covers for other types of golf clubs are disclosed in U.S. patent application Ser. No. 07/735,915 referenced above.

In view of the foregoing, it is readily apparent that the prior art putter covers have various drawbacks which are obviously undesirable.

SUMMARY OF THE INVENTION

It is therefore, an object of the present invention to overcome these and other drawbacks of the prior art.

Specifically, it is one object of the present invention to provide a cover for the head of a golf putter having a shaft and a head with a striking face. The putter cover is constructed from a single piece of substantially elastic material having a preformed opening and upper and lower surfaces. With a single fold, the material is folded along a first edge portion to define first and second material portions. These first or upper and second or lower material portions are joined along second, third and fourth edge portions thereof to form a elongated casing for covering the putter head.

It is a further object of the present invention to provide a putter cover wherein the opening if formed entirely within one of the first or second material portions.

It is a further object of the present invention to provide a putter cover wherein the material is made of an elastic rubber material such as neoprene.

It is a further object of the present invention to provide a putter cover wherein the material has a thickness of about 5 mm.

It is a further object of the present invention to provide a putter cover wherein the material is waterproof.

It is a further object of the present invention to provide a putter cover wherein the second, third and fourth edge portions are joined by a single continuous stitch.

It is a further object of the present invention to provide a putter cover wherein the first and second material portions have a major axis and the opening has a major axis transverse to the major axis of each of the first and second material portions.

It is a further object of the present invention to provide a putter cover wherein the first and second material portions have a major axis and the striking face has a major axis substantially parallel to the major axis of each of the first and second material portions when the putter is disposed in the cover.

It is a further object of the present invention to provide a putter cover wherein the upper and lower surfaces of the single piece of material are aesthetically pleasing and the cover is reversible.

It is a further object of the present invention to provide a putter cover which is substantially planar and wherein the upper and lower surfaces of the single piece of material are disposed such that they are generally perpendicular to the striking face when the putter is disposed in the cover.

It is a further object of the invention to provide a water tight putter cover that can accommodate a variety of putter configurations, regardless of shaft position.

It is a further object of the present invention to provide a putter cover prepared by a novel process. This process comprises the steps of obtaining a single piece of substantially planar elastic material having upper and lower surfaces; cutting the material to form a desired shape for the material and to form an opening in the material; folding the material along an edge portion to define first and second material portions and to provide a first edge portion common to the first and second material portions; and joining the first and second material portions along second, third and fourth edge portions to form an elongated casing.

It is a further object of the present invention to provide a putter cover prepared by a process wherein the joining step comprises a single sewing step.

It is a further object of the present invention to provide a putter cover prepared by a process wherein the shape of the material and the opening are formed in a single operation. A detailed description of these and other objects is set forth below with reference to the drawings filed herewith.

DESCRIPTION OF THE PREFERRED EMBODIMENTS

Figure 1:
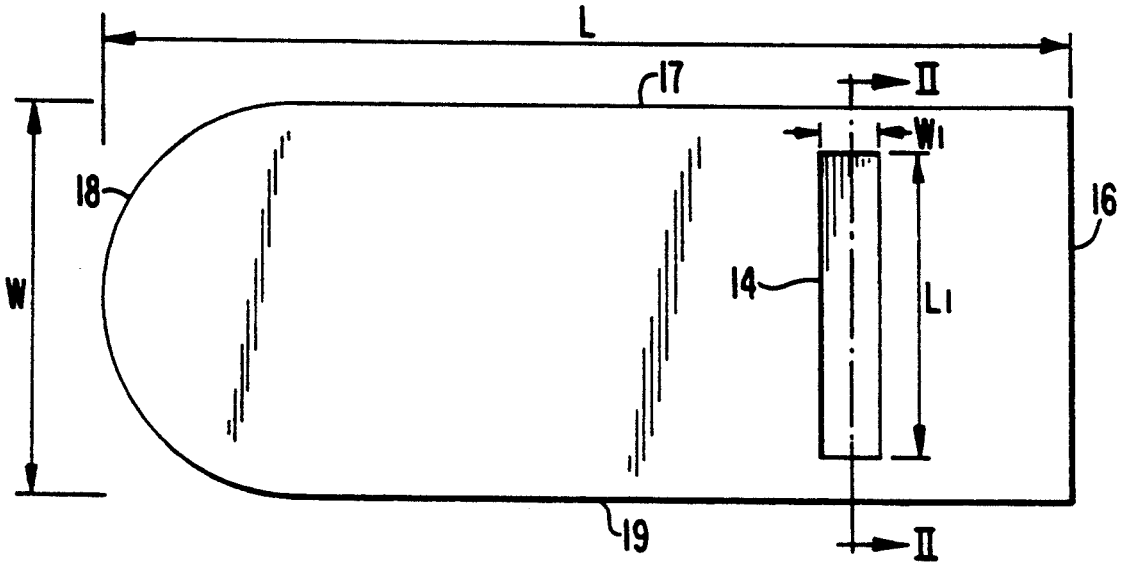
FIG. 1 is a plan view of an improved putter cover according to one embodiment of the present invention.
Figure 2:
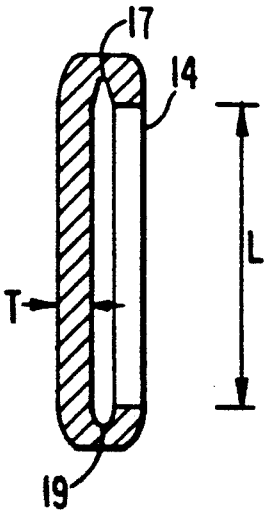
FIG. 2 is a partial sectional view of the putter cover embodiment of FIG. 1 taken along line II—II.
Figure 3:
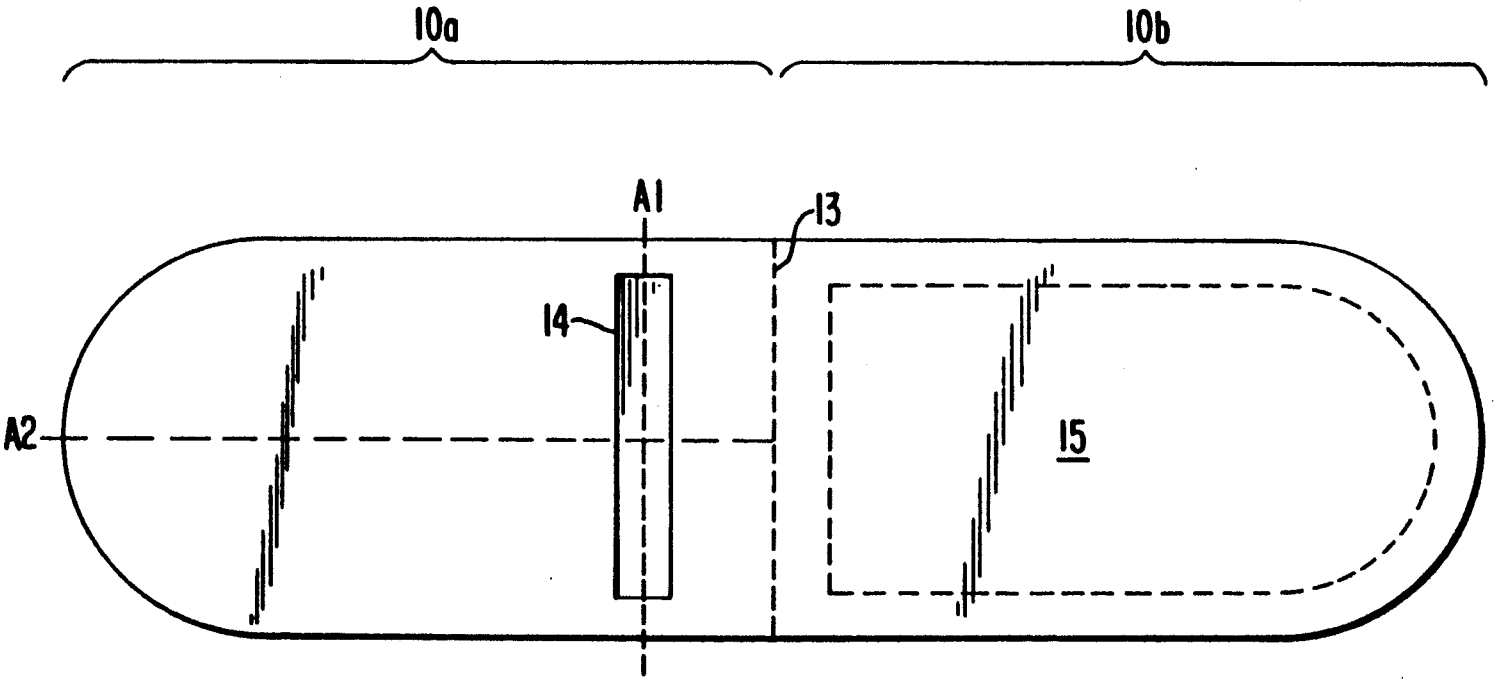
FIG. 3 illustrates a general shape to which the cover of FIG. 1 may be cut prior to it being sewn according to one embodiment of the invention.

Referring to FIGS. 1-3, according to one embodiment of the invention, the cover may be assembled by cutting a single piece of material, having upper and lower surfaces, into a desired shape, for example, the general shape shown in FIG. 3. The shape of the material in FIG. 3 is representative of a family of shapes whose outline allows the shape to be folded along a line 13 defining material portions 10*a* and 10*b*. Preferably, an opening 14 is formed in one of material portions 10*a* or 10*b* during the step of cutting the desired shape. However, the opening 14 and the shape of the material may also be formed in separate operations. Preferably, the opening is located closer to line 13 than to edge 18.

The opening 14 will be referred to as a preformed opening to indicate that it is formed prior to sewing or other securing operations. The preformed opening 14 is entirely disposed within one of material portions 10*a* or 10*b* and overcomes the drawbacks of openings formed by partially stitching two sides together, for example.

The next step in the manufacture of the cover is to fold portions 10*a* and 10*b* along line 13, so that the fold of potions 10*a* and 10*b* form an upper material portions 10*a* and a lower material portions 10*b* and a first edge portion 16 which corresponds to the line 13. The perimeter of material portions 10*a* and 10*b* may then be stitched or otherwise fastened in one continuous step along edge portions 17, 18 and 19. Preferably, the first edge portion 16, along which the material is folded, will comprise a substantially straight edge. A second edge portion 17 and a fourth edge portion 19 are preferably substantially parallel to one another. A third edge portion 18 is preferably curvilinear, but may also comprise one or more linear portions, and preferably is contiguous with edge portions 17 and 19.

According to one aspect of the present invention, the putter cover is preferably made of an elastic rubber material such as neoprene. While neoprene is the preferred material for implementing the present invention, similar types of material can also be used. While several advantages of using neoprene are disclosed herein, one advantage is that it has a "memory" for a club shape. In general, it is desired not to use less elastic materials such as plastics, leather or nylon which are less weather resistant and are subject to cracking, expansion and other undesirable affects. The thickness T (FIG. 2) of the elastic material may be generally between 2-6 mm, but 5 mm is considered to be preferable.

Figure 4:
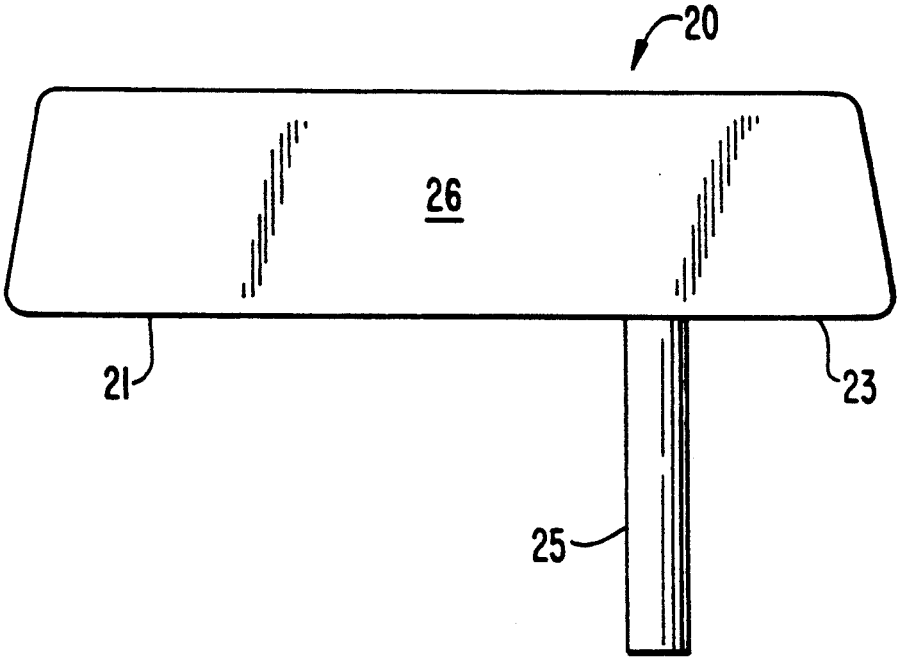
FIG. 4 illustrates an example of a putter to be covered by the putter cover embodiment of FIG. 1.

In order to use the cover, the user merely slips a first portion 21 of a putter head 20 (see FIGS. 4 and 5) into the opening 14 such that the end of the first portion 21 of putter head 20 either contacts or comes in close proximity to the third edge portion 18. Then, a second portion 23 of putter head 20 is inserted into the opening 14 by stretching the cover over the second portion 23. Due to the physical characteristics of the neoprene and the size of the opening, the cover fits snugly over the putter to ensure that the cover remains on the putter until the user desires to remove it. This is true regardless of the position of the shaft of the putter.

Once the putter cover is properly positioned on the putter, one possible logo area 15 will be prominently displayed, especially when the covered putter is viewed from above. Of course, other portions may be used for logos as well. Advantageously, the surfaces of the material portions 10*a* and 10*b* will be substantially perpendicular to the face 26 of the putter head 20.

Advantageously, the construction of the present invention is quite simple, and may be accomplished with only a single cutting operation and a single sewing operation. Additionally, due to the elasticity of the material and general configuration of the cover, the cover of the present invention is reversible, providing for extended wear, multiple logos and alternative colors. Moreover, the cover is comparatively more water and weather resistant than the prior art covers since the elastic material tends to snugly fit the putter and form a seal when contacting the putter regardless of shaft position. Moreover, according to the preferred embodiment, there is less opportunity for water to enter into the cover.

Furthermore, as shown in FIG. 3, for example, the major axis of the opening A1 extends transversely to the major axis of the putter A2. This configuration, in combination with the elastic material, has the advantage of holding the putter more securely thereby minimizing the chance that the cover will accidentally or unintentionally fall off of the putter and minimizes exposure of the putter to the weather and other undesirable elements. This advantage is not believed to be provided by prior covers.

Figure 5:
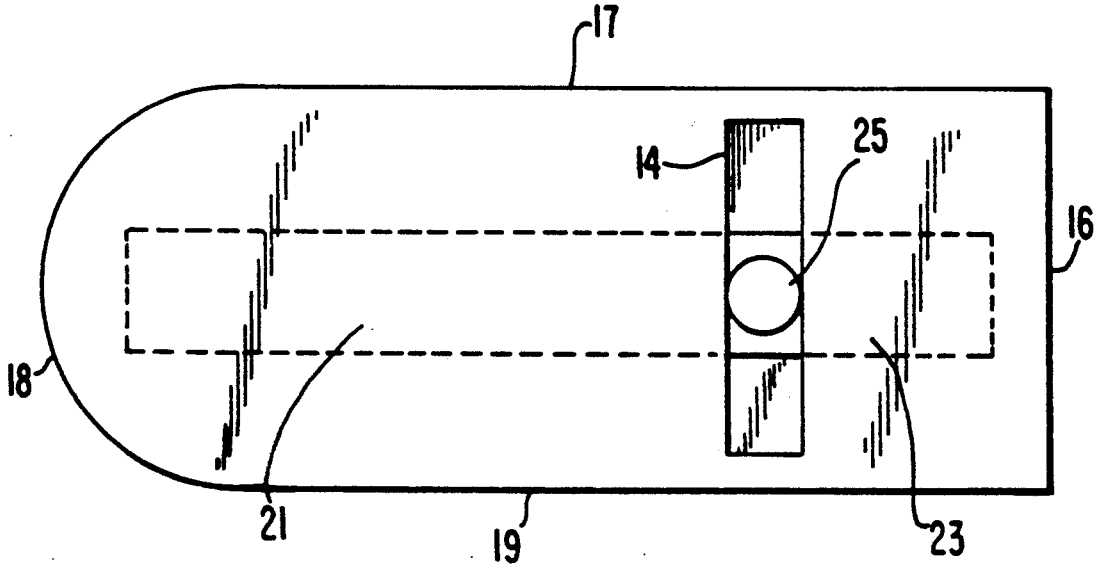
FIG. 5 illustrates a putter inserted in the putter cover embodiment of FIGS. 1 and 2.

The opening 14, as shown in FIG. 1, is generally rectangular, but may be formed in other shapes. Preferably, the size of the opening 14 is no larger than is necessary to enable the cover to extend over the first and second portions (21 and 23) of the putter. This further minimizes the chances of the cover accidently falling off the putter and maximizes water tightness of the cover. For example, according to one embodiment, depending on the elasticity of the material, the width W1 (FIG. 1) of the opening 14 may be about ⅜" and the length L1 of the opening 14 may be about 1 ¾". The length L of the entire cover may be about 6 ¼", but preferably slightly shorter than the length of the putter depending on the elasticity of the material. The width W of the cover may be about 2 ½ or less. According to one embodiment the width W may be slightly smaller than the width of the putter head 20 depending on the elasticity of the material. In general, the cover should be dimensioned so that it fits snugly on the putter head 20 to be covered. As shown in FIG. 5, the opening 14 may be positioned to correspond to the position of the shaft 25 of the putter to be covered. However, due to the elasticity of the material, the position of the opening shown is also effective to cover putters having varying shaft positions.

While the preferred shape of the cover is as shown in FIG. 1, various alternatives will be readily apparent to one of ordinary skill in the art. In general, it is desirable to have an aesthetically pleasing shape that does not require multiple sewing steps. While the first edge portion 16 is preferably straight, it may be contoured, with either the same or a different shape than the third edge portion 18. In this case, it may be desirable to modify the shape of the material portions 10*a* and 10*b* in the vicinity of the line 13. Moreover, while the second edge portion 17 and fourth edge portion 19 may generally be mirror images of each other, if desired, they may have differing contours. Of course, it would be desirable that the corresponding portions of 10*a* and 10*b* which form edge portion 17 be substantially the same and, similarly, the corresponding portions of 10*a* and 10*b* which form edge portions 18 and 19, respectively, should also be substantially the same.

While it is preferred to stitch the cover to join the respective edges, other fastening devices may be used in conjunction with or in place of the stitching.

The foregoing is a description of the preferred embodiments of the present invention. Various modifications and improvements will be readily apparent to one of ordinary skill in the art. The invention is not limited to the preferred embodiments, and is only limited by the claims appended hereto

I claim:

1. A cover for the head of a golf putter comprising a shaft and a head, said head having a striking face, said cover comprising:

a single piece of elongated, substantially elastic material having a preformed opening disposed completely through said material, said material being folded substantially across its middle to form a first edge and to define an upper material portion having the preformed opening and a lower material portion; and joining means for continuously joining said upper and lower material portions, said joining means extending from a first side of said first edge to an opposite side of said first edge to form a substantially elongated casing which is continuously closed along its sides for covering said putter head.

2. The cover of claim 1, wherein said material substantially comprises neoprene.

3. The cover of claim 1, wherein said material has a thickness greater than about 3 mm.

4. The cover of claim 1, wherein said material is waterproof and weather resistant.

5. The cover of claim 1, wherein said joining means comprises a continuous stitch.

6. The cover of claim 1, wherein said upper and lower material portions have a major axis and said opening has a major axis transverse to the major axis of each of said upper and lower material portions.

7. The cover of claim 1, wherein said upper and lower material portions have a major axis and said striking face has a major axis substantially parallel to the major axis of each of said upper and lower material portions, when said putter is disposed in said cover.

8. The cover of claim 1, wherein said cover further comprises means for reversing said cover in said upper material portion.

9. The cover of claim 1, wherein said cover is substantially planar and said upper and lower material portions of said cover are disposed such that they are generally perpendicular to said striking face, when said putter is disposed in said cover.

10. A cover for the head of a golf putter comprising a shaft and a head, said head having a striking face, said cover comprising:

a top side lying within a first plane and having an elongated shape and a perimeter with a length, said top side made form an elastic material and having a preformed opening extending entirely through said top side for accepting said head; and a bottom side lying within a second plane parallel to said first plane of said top side and having an elongated shape and a perimeter with a length, said bottom side made form an elastic material, said top side and said bottom side being continuously joined along the entire length of their perimeters.

11. A cover for the head of a golf putter comprising a shaft and a head, said head having a vertical striking face, said cover comprising:

a single piece of elongated, elastic material having a means for inserting and withdrawing said putter into and from said cover disposed through said elastic material, said material being folded substantially across its middle to form a first edge and to define an upper material portion containing said means for inserting and withdrawing said putter and a lower material portion; and single, continuous stitching extending from a first side of said first edge to an opposite side of said first edge thereby joining said upper and lower material portions and forming a substantially elongated casing which is continuously closed along its edges and with said means for inserting and withdrawing said putter on top of said casing, whereby when said head is fully inserted into said cover, said upper and lower material portions are generally perpendicular to said striking face.

* * * * *